US008573398B2

(12) United States Patent
Reinke et al.

(10) Patent No.: US 8,573,398 B2
(45) **Date of Patent: *Nov. 5, 2013**

(54) REFILLABLE FLEXIBLE SHEET DISPENSER

(75) Inventors: Christopher Reinke, Townsend, MA (US); Charles W. Sears, Boxford, MA (US); Michael A. Susi, Marlborough, MA (US); David H. Pitcher, Worcester, MA (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 962 days.

This patent is subject to a terminal disclaimer.

(21) Appl. No.: 11/167,285

(22) Filed: Jun. 28, 2005

(65) Prior Publication Data

US 2005/0236416 A1 Oct. 27, 2005

Related U.S. Application Data

(63) Continuation of application No. 10/155,028, filed on May 28, 2002, now Pat. No. 6,910,579.

(51) Int. Cl.
*B65D 85/16* (2006.01)

(52) U.S. Cl.
USPC ..... 206/494; 206/233; 206/812

(58) Field of Classification Search
USPC ..... 206/494, 812, 449, 233, 409, 229, 210, 206/207, 205, 440, 438; 221/49, 62, 63, 221/303, 307–310, 61, 36, 39, 41, 48, 45; 220/253, 524, 525, 254.3, 254.4, 220/254.6, 256.1, 826, 259.1, 254.2, 213, 220/229, 203.17, 263, 264
See application file for complete search history.

(56) References Cited

U.S. PATENT DOCUMENTS 1,603,714 A * 10/1926 Rappleye ..... 221/48
1,773,652 A 8/1930 Traver (Continued)

FOREIGN PATENT DOCUMENTS

DE 1806827 A1 5/1970
DE 2437672 A1 2/1975

(Continued)

OTHER PUBLICATIONS

English machine translation of: JP 2002-68333 A, published Mar. 8, 2002, Yoshino Kogyosho Co Ltd, entitled "Pull-Out Port for Tissue Paper".

(Continued)

*Primary Examiner* — Jacob K Ackun
*Assistant Examiner* — Jenine Pagan
(74) *Attorney, Agent, or Firm* — Michael V. Kruljac; Ram W. Sabnis

(57) ABSTRACT

A flexible sheet container is provided that permits a user to quickly and easily feed a leading sheet. The container has a base portion that defines a storage area and a top covering the base portion. The top includes an opening into the storage area through which individual flexible sheets are dispensed. A pair of opposing flaps is pivotally attached to the top at their first ends and each extends toward the dispensing opening with its second end. The complementary second ends of the flaps together further define the dispensing opening while in a dispensing position. The flaps pivot inward toward the storage area to provide access through the opening into the storage area. As such, to feed a leading flexible sheet, a user may rotate the flaps inward, grab a leading flexible sheet, and pull it through the opening. During dispensing, the flaps rotate outward and retain subsequent sheets.

15 Claims, 10 Drawing Sheets

(56) References Cited

U.S. PATENT DOCUMENTS

| | | | | | |
|---|---|---|---|---|---|
| 2,323,395 | A | | 7/1943 | Harwood | |
| 2,598,050 | A | * | 5/1952 | Guyer | 221/52 |
| 2,636,599 | A | * | 4/1953 | Willis et al. | 221/48 |
| 2,890,791 | A | | 6/1959 | Wenzel | |
| 2,994,453 | A | | 8/1961 | Gardiner | |
| 3,061,080 | A | | 10/1962 | Stephen | |
| 3,083,859 | A | | 4/1963 | Gardiner | |
| 3,155,273 | A | | 11/1964 | Cote | |
| 3,473,694 | A | | 10/1969 | Murphy et al. | |
| 3,613,142 | A | | 10/1971 | Chaney, Jr. | |
| 3,637,109 | A | * | 1/1972 | Stifter | 221/310 |
| 3,749,296 | A | * | 7/1973 | Harrison | 225/106 |
| 3,780,908 | A | | 12/1973 | Fitzpatrick et al. | |
| 3,836,044 | A | | 9/1974 | Tilp et al. | |
| 3,843,017 | A | | 10/1974 | Harrison | |
| 3,868,052 | A | | 2/1975 | Rockefeller | |
| 3,967,756 | A | | 7/1976 | Barish | |
| 3,979,019 | A | | 9/1976 | Bliss | |
| 3,982,659 | A | * | 9/1976 | Ross | 221/63 |
| 3,982,685 | A | | 9/1976 | Shimada | |
| 3,986,479 | A | | 10/1976 | Bonk | |
| 3,994,417 | A | | 11/1976 | Boedecker | |
| 4,002,264 | A | | 1/1977 | Marchesani | |
| 4,037,754 | A | * | 7/1977 | Wilhelmi et al. | 220/254.2 |
| 4,138,034 | A | | 2/1979 | McCarthy | |
| 4,180,160 | A | | 12/1979 | Ogawa et al. | |
| 4,289,262 | A | | 9/1981 | Finkelstein | |
| 4,328,904 | A | * | 5/1982 | Iverson | 220/229 |
| 4,328,907 | A | | 5/1982 | Beard | |
| 4,534,491 | A | * | 8/1985 | Norton et al. | 221/63 |
| 4,651,895 | A | | 3/1987 | Niske et al. | |
| 4,679,700 | A | * | 7/1987 | Tharrington et al. | 220/825 |
| D295,830 | S | | 5/1988 | Holly | |
| D295,961 | S | | 5/1988 | Holly | |
| 4,848,575 | A | | 7/1989 | Nakamura et al. | |
| 4,884,717 | A | | 12/1989 | Bussard | |
| D311,334 | S | | 10/1990 | Flynn et al. | |
| 4,969,554 | A | * | 11/1990 | Sawaya | 206/370 |
| 5,040,680 | A | | 8/1991 | Wilson et al. | |
| 5,050,737 | A | | 9/1991 | Joslyn et al. | |
| 5,219,421 | A | | 6/1993 | Tipping | |
| 5,271,500 | A | | 12/1993 | Szacon | |
| 5,322,178 | A | | 6/1994 | Foos | |
| 5,330,069 | A | | 7/1994 | Jamison et al. | |
| D358,918 | S | | 5/1995 | Gale | |
| 5,413,243 | A | | 5/1995 | Bemis | |
| D365,755 | S | | 1/1996 | Kanfer et al. | |
| D367,609 | S | | 3/1996 | Frank et al. | |
| 5,501,323 | A | | 3/1996 | Denesha et al. | |
| 5,516,001 | A | | 5/1996 | Muckenfuhs et al. | |
| 5,542,566 | A | | 8/1996 | Glaug et al. | |
| 5,542,567 | A | | 8/1996 | Julius | |
| 5,542,568 | A | | 8/1996 | Julius | |
| 5,553,702 | A | * | 9/1996 | Walsh | 206/38 |
| 5,560,514 | A | | 10/1996 | Frazier | |
| 5,573,132 | A | | 11/1996 | Kanfer et al. | |
| 5,637,099 | A | * | 6/1997 | Durdin et al. | 604/192 |
| 5,655,680 | A | | 8/1997 | Asbach | |
| 5,676,331 | A | | 10/1997 | Weber | |
| 5,687,875 | A | | 11/1997 | Watts | |
| 5,695,098 | A | * | 12/1997 | King | 224/148.7 |
| 5,699,912 | A | | 12/1997 | Ishikawa et al. | |
| 5,704,471 | A | | 1/1998 | Yamada | |
| 5,718,353 | A | | 2/1998 | Kanfer | |
| 5,729,955 | A | | 3/1998 | Yamada | |
| 5,755,356 | A | * | 5/1998 | Bastiaens et al. | 221/33 |
| 5,785,179 | A | | 7/1998 | Buczwinski et al. | |
| 5,875,791 | A | | 3/1999 | Sheffler et al. | |
| 5,884,804 | A | | 3/1999 | King | |
| D412,439 | S | | 8/1999 | Cormack | |
| 5,947,672 | A | * | 9/1999 | Cohen | 411/525 |
| D414,637 | S | * | 10/1999 | Amundson et al. | D9/734 |
| D416,794 | S | | 11/1999 | Cormack | |
| 6,010,265 | A | | 1/2000 | Bouix | |
| D421,901 | S | | 3/2000 | Hill | |
| 6,053,357 | A | | 4/2000 | Yoh | |
| 6,065,626 | A | * | 5/2000 | Huang et al. | 220/254.5 |
| 6,092,690 | A | | 7/2000 | Bitowft et al. | |
| 6,145,782 | A | | 11/2000 | King et al. | |
| D442,081 | S | | 5/2001 | Paul | |
| D443,450 | S | | 6/2001 | Ruhotas et al. | |
| D443,451 | S | | 6/2001 | Buck et al. | |
| D443,508 | S | | 6/2001 | Braaten et al. | |
| D446,014 | S | | 8/2001 | Adkins | |
| D450,960 | S | | 11/2001 | Boyea et al. | |
| 6,315,114 | B1 | | 11/2001 | Keck et al. | |
| 6,394,298 | B1 | | 5/2002 | Zaidman | |
| 6,409,044 | B1 | | 6/2002 | Brown et al. | |
| 6,412,656 | B1 | | 7/2002 | Placik | |
| 6,419,114 | B1 | | 7/2002 | Lenz et al. | |
| 6,499,626 | B1 | * | 12/2002 | Julius | 221/63 |
| 6,554,156 | B1 | | 4/2003 | Chong | |
| 6,585,131 | B2 | | 7/2003 | Huang | |
| 6,592,004 | B2 | | 7/2003 | Huang et al. | |
| 6,604,628 | B1 | * | 8/2003 | Tanaka et al. | 206/209 |
| 6,672,549 | B2 | * | 1/2004 | Kolb | 248/127 |
| 6,688,488 | B2 | | 2/2004 | Bailey | |
| 6,951,292 | B2 | | 10/2005 | Bando | |
| 2002/0017522 | A1 | * | 2/2002 | Bando et al. | 220/254 |
| 2002/0179625 | A1 | | 12/2002 | Huang | |
| 2002/0179626 | A1 | | 12/2002 | Huang | |
| 2003/0159403 | A1 | * | 8/2003 | Verespej et al. | 53/412 |

FOREIGN PATENT DOCUMENTS

| | | | |
|---|---|---|---|
| DE | 2603085 | A1 | 8/1976 |
| DE | 7715417 | U1 | 9/1977 |
| DE | 7901934 | U1 | 4/1979 |
| DE | 2915261 | A1 | 7/1980 |
| DE | 8123069 | U1 | 11/1981 |
| DE | 3133237 | A1 | 3/1983 |
| DE | 3300421 | A1 | 7/1983 |
| DE | 8701838 | U1 | 4/1987 |
| DE | 8809213 | U1 | 9/1988 |
| DE | 8813736 | U1 | 6/1989 |
| DE | 9208932 | U1 | 10/1992 |
| DE | 69314725 | T2 | 2/1994 |
| DE | 4308135 | A1 | 9/1994 |
| DE | 69422798 | T2 | 11/1995 |
| DE | 29703355 | U1 | 4/1997 |
| DE | 29823042 | U1 | 4/1999 |
| DE | 20000604 | U1 | 3/2000 |
| DE | 10024425 | A1 | 4/2001 |
| DE | 60102196 | T2 | 4/2002 |
| DE | 60001751 | T2 | 5/2002 |
| EP | 0006709 | A1 | 1/1980 |
| EP | 0030348 | A1 | 6/1981 |
| EP | 0030506 | A1 | 6/1981 |
| EP | 0034121 | A1 | 8/1981 |
| EP | 0048419 | A1 | 9/1981 |
| EP | 0039297 | A1 | 11/1981 |
| EP | 0046548 | A1 | 3/1982 |
| EP | 0047013 | A1 | 3/1982 |
| EP | 0048180 | A2 | 3/1982 |
| EP | 0006709 | B1 | 7/1982 |
| EP | 0058078 | A2 | 8/1982 |
| EP | 0061248 | A2 | 9/1982 |
| EP | 0066840 | A1 | 12/1982 |
| EP | 0096546 | A2 | 12/1983 |
| EP | 0110473 | A1 | 6/1984 |
| EP | 0119314 | A2 | 9/1984 |
| EP | 0130146 | A2 | 1/1985 |
| EP | 0137330 | A2 | 4/1985 |
| EP | 0139544 | A2 | 5/1985 |
| EP | 0143518 | A1 | 6/1985 |
| EP | 0146793 | A2 | 7/1985 |
| EP | 0164797 | A2 | 12/1985 |
| EP | 0193130 | A2 | 9/1986 |
| EP | 0238794 | A1 | 9/1987 |
| EP | 0251103 | A1 | 1/1988 |
| EP | 0258515 | A1 | 3/1988 |
| EP | 0265552 | A1 | 5/1988 |
| EP | 0283421 | A1 | 9/1988 |
| EP | 0290032 | A2 | 11/1988 |

(56) References Cited

FOREIGN PATENT DOCUMENTS

| | | | |
|---|---|---|---|
| EP | 0295503 | A1 | 12/1988 |
| EP | 0298931 | B1 | 1/1989 |
| EP | 0302382 | A1 | 2/1989 |
| EP | 0303743 | A1 | 2/1989 |
| EP | 0312474 | A1 | 4/1989 |
| EP | 0336953 | A1 | 5/1989 |
| EP | 0323596 | A1 | 7/1989 |
| EP | 0325360 | A1 | 7/1989 |
| EP | 0325761 | A1 | 8/1989 |
| EP | 0331027 | A1 | 9/1989 |
| EP | 0331653 | A2 | 9/1989 |
| EP | 0332391 | A1 | 9/1989 |
| EP | 0340112 | A1 | 11/1989 |
| EP | 0345057 | A1 | 12/1989 |
| EP | 0382809 | A1 | 12/1989 |
| EP | 0349471 | A2 | 1/1990 |
| EP | 0364896 | A1 | 4/1990 |
| EP | 0372781 | A1 | 6/1990 |
| EP | 0412139 | A1 | 8/1990 |
| EP | 0391865 | A2 | 10/1990 |
| EP | 0392696 | A1 | 10/1990 |
| EP | 0413407 | A1 | 2/1991 |
| EP | 0413408 | A1 | 2/1991 |
| EP | 0420301 | A1 | 4/1991 |
| EP | 0441529 | A2 | 8/1991 |
| EP | 0451292 | A1 | 10/1991 |
| EP | 0452577 | A1 | 10/1991 |
| EP | 0457731 | A1 | 11/1991 |
| EP | 0451292 | A4 | 4/1992 |
| EP | 0488877 | A1 | 6/1992 |
| EP | 0488967 | A1 | 6/1992 |
| EP | 0565632 | A1 | 7/1992 |
| EP | 0567538 | A1 | 8/1992 |
| EP | 0501260 | A1 | 9/1992 |
| EP | 0503636 | A1 | 9/1992 |
| EP | 0506244 | A1 | 9/1992 |
| EP | 0580722 | A1 | 11/1992 |
| EP | 0532390 | A1 | 3/1993 |
| EP | 0534600 | A2 | 3/1993 |
| EP | 0534600 | A3 | 3/1993 |
| EP | 0546369 | A1 | 6/1993 |
| EP | 0550863 | A1 | 7/1993 |
| EP | 0555577 | A1 | 8/1993 |
| EP | 0630345 | A1 | 9/1993 |
| EP | 0579892 | A1 | 1/1994 |
| EP | 0586272 | A1 | 3/1994 |
| EP | 0593182 | A1 | 4/1994 |
| EP | 0664682 | A1 | 4/1994 |
| EP | 0681443 | A1 | 8/1994 |
| EP | 0682492 | A1 | 8/1994 |
| EP | 0686189 | A1 | 9/1994 |
| EP | 0621561 | A2 | 10/1994 |
| EP | 0702651 | A1 | 12/1994 |
| EP | 0641537 | A2 | 3/1995 |
| EP | 0657134 | A1 | 6/1995 |
| EP | 0748401 | A1 | 9/1995 |
| EP | 0789642 | A1 | 9/1995 |
| EP | 0703831 | A1 | 10/1995 |
| EP | 0679357 | A1 | 11/1995 |
| EP | 0688728 | A1 | 12/1995 |
| EP | 0698366 | A1 | 2/1996 |
| EP | 0777435 | A1 | 3/1996 |
| EP | 0791096 | A1 | 5/1996 |
| EP | 0791097 | A2 | 5/1996 |
| EP | 0793607 | A1 | 5/1996 |
| EP | 0750470 | A1 | 6/1996 |
| EP | 0800478 | A1 | 7/1996 |
| EP | 0805642 | A1 | 7/1996 |
| EP | 0728445 | A1 | 8/1996 |
| EP | 0754012 | A1 | 8/1996 |
| EP | 0813382 | A1 | 9/1996 |
| EP | 0814695 | A1 | 9/1996 |
| EP | 0738667 | A1 | 10/1996 |
| EP | 0773736 | A1 | 11/1996 |
| EP | 0748748 | A1 | 12/1996 |
| EP | 0839014 | A1 | 12/1996 |
| EP | 0758539 | A1 | 2/1997 |
| EP | 0760343 | A1 | 3/1997 |
| EP | 0768057 | A2 | 4/1997 |
| EP | 0852473 | A1 | 4/1997 |
| EP | 0861042 | A1 | 5/1997 |
| EP | 0776966 | A1 | 6/1997 |
| EP | 0807068 | A1 | 6/1997 |
| EP | 0686189 | B1 | 7/1997 |
| EP | 0768057 | A3 | 7/1997 |
| EP | 0773736 | A4 | 7/1997 |
| EP | 0837645 | A1 | 11/1997 |
| EP | 0897278 | A1 | 11/1997 |
| EP | 0681443 | B1 | 12/1997 |
| EP | 0682492 | B1 | 12/1997 |
| EP | 0915679 | A1 | 12/1997 |
| EP | 0750470 | A4 | 2/1998 |
| EP | 0918692 | A1 | 2/1998 |
| EP | 0832823 | A2 | 4/1998 |
| EP | 0930853 | A1 | 4/1998 |
| EP | 0934015 | A1 | 4/1998 |
| EP | 0858758 | A1 | 6/1998 |
| EP | 0942816 | A1 | 7/1998 |
| EP | 0972104 | A1 | 7/1998 |
| EP | 0703831 | B1 | 12/1998 |
| EP | 0959808 | A1 | 12/1998 |
| EP | 0832823 | A3 | 1/1999 |
| EP | 0814695 | B1 | 2/1999 |
| EP | 1017303 | A1 | 2/1999 |
| EP | 0909545 | A1 | 4/1999 |
| EP | 1022986 | A2 | 4/1999 |
| EP | 0913336 | A1 | 5/1999 |
| EP | 0915025 | A1 | 5/1999 |
| EP | 1027262 | A1 | 5/1999 |
| EP | 1043946 | A1 | 6/1999 |
| EP | 0738667 | B1 | 7/1999 |
| EP | 0793607 | B1 | 7/1999 |
| EP | 0930243 | A1 | 7/1999 |
| EP | 0984715 | A1 | 10/1999 |
| EP | 1065988 | A1 | 10/1999 |
| EP | 0953313 | A1 | 11/1999 |
| EP | 1075436 | A1 | 11/1999 |
| EP | 1076505 | A1 | 11/1999 |
| EP | 0963730 | A2 | 12/1999 |
| EP | 0964242 | A2 | 12/1999 |
| EP | 1083815 | A1 | 12/1999 |
| EP | 0758539 | B1 | 1/2000 |
| EP | 1091678 | A1 | 1/2000 |
| EP | 0980841 | A2 | 2/2000 |
| EP | 0983739 | A2 | 3/2000 |
| EP | 0983740 | A2 | 3/2000 |
| EP | 0768057 | B1 | 7/2000 |
| EP | 1033100 | A2 | 9/2000 |
| EP | 0980841 | A3 | 10/2000 |
| EP | 1044643 | A1 | 10/2000 |
| EP | 1044894 | A1 | 10/2000 |
| EP | 1048257 | A2 | 11/2000 |
| EP | 1048589 | A1 | 11/2000 |
| EP | 1053956 | A1 | 11/2000 |
| EP | 1175171 | A1 | 11/2000 |
| EP | 1176900 | A1 | 11/2000 |
| EP | 0963730 | A3 | 12/2000 |
| EP | 0789642 | B1 | 1/2001 |
| EP | 0983739 | A3 | 1/2001 |
| EP | 0983740 | A3 | 1/2001 |
| EP | 1066784 | A1 | 1/2001 |
| EP | 0964242 | A3 | 4/2001 |
| EP | 0664682 | B1 | 5/2001 |
| EP | 1033100 | A3 | 9/2001 |
| EP | 1129656 | A1 | 9/2001 |
| EP | 1017303 | B1 | 12/2001 |
| EP | 1181884 | A1 | 2/2002 |
| EP | 1197443 | A1 | 4/2002 |
| EP | 1201564 | A | 5/2002 |
| EP | 1201564 | A1 | 5/2002 |
| EP | 1201565 | A1 | 5/2002 |
| EP | 1201564 | B1 | 3/2003 |
| GB | 1476303 | A | 6/1977 |
| JP | 55-32150 | | 8/1953 |

(56) References Cited

FOREIGN PATENT DOCUMENTS

| | | | |
|---|---|---|---|
| JP | 55-32148 | | 3/1980 |
| JP | 55-49612 | | 4/1980 |
| JP | 63-3972 | U | 1/1988 |
| JP | 5-44879 | U | 6/1993 |
| JP | 6-18281 | U | 3/1994 |
| JP | 6263174 | A | 9/1994 |
| JP | 6-72491 | U | 10/1994 |
| JP | H8-104377 | | 4/1996 |
| JP | 2517731 | Y2 | 11/1996 |
| JP | 2002-68333 | A | 3/2002 |
| WO | 81/00704 | A1 | 3/1981 |
| WO | 87/02020 | A1 | 4/1987 |
| WO | 92/12072 | A2 | 7/1992 |
| WO | 93/05932 | A1 | 4/1993 |
| WO | 93/13003 | A1 | 7/1993 |
| WO | 94/08500 | A1 | 4/1994 |
| WO | 94/09455 | A1 | 4/1994 |
| WO | 94/11270 | A1 | 5/1994 |
| WO | 95/25317 | A1 | 9/1995 |
| WO | 95/26312 | A1 | 10/1995 |
| WO | 96/20873 | A1 | 7/1996 |
| WO | 96/41562 | A1 | 12/1996 |
| WO | 97/04714 | A1 | 2/1997 |
| WO | 97/39964 | A1 | 10/1997 |
| WO | WO 97/39964 | A | 10/1997 |
| WO | 97/47532 | A1 | 12/1997 |
| WO | 98/42240 | A1 | 10/1998 |
| WO | 99/27833 | A1 | 6/1999 |
| WO | 00/29224 | A2 | 5/2000 |
| WO | 00/76864 | A1 | 12/2000 |
| WO | 01/34353 | A1 | 5/2001 |
| WO | 01/41613 | A1 | 6/2001 |
| WO | 01/64531 | A1 | 9/2001 |
| WO | 01/87717 | A2 | 11/2001 |
| WO | 02/11802 | A2 | 2/2002 |
| WO | 02/39863 | A1 | 5/2002 |

OTHER PUBLICATIONS

English translation of: JP 55-49612, published Apr. 1, 1980, Kabushikikaisha Yoshino Kogyosho, entitled "Tissue paper container pull-out port structure".

*Georgia-Pacific Consumer Products LP* v. *The Clorox Co., et al.*, Civil Action File No. 08-CV-01176, complaint filed Mar. 25, 2008, in the U. S. District Court for the Northern District of Georgia.

*Georgia-Pacific Consumer Products LP* v. *The Clorox Co., et al.*, Civil Action File No. 08-CV-01176, docket sheet for complaint filed Mar. 25, 2008, in the U. S. District Court for the Northern District of Georgia.

Extended European Search Report dated Aug. 20, 2008 that issued in European patent application No. 08075164.7, Europe.

English translation of: JP 55-32148, published Mar. 1, 1980, Toppan Printing Co., Ltd, entitled "Container for drawing out cloth made of paper, such as moist towelette" (Examined Utility Model Application Publication No. JP58-027983Y).

English translation of: JP H8-104377, published Apr. 23, 1996, Kabushikikaisha Okay, entitled "Wet tissue supply kit".

English machine translation of: JP 2517731 Y2, published Nov. 20, 1996, entitled "Box shape container for wet tissues".

* cited by examiner

REFILLABLE FLEXIBLE SHEET DISPENSER

CROSS-REFERENCE TO RELATED APPLICATIONS

This application is a continuation application of co-pending U.S. patent application Ser. No. 10/155,028, filed May 28, 2002, the contents of which are expressly incorporated herein by reference

FIELD OF THE INVENTION

This invention relates generally to flexible sheet containers. More particularly, the present invention relates to dispensing flexible sheet containers that are refillable and to methods for feeding and refilling the flexible sheets.

BACKGROUND OF THE INVENTION

Flexible sheet containers are well known and come in a variety of shapes and sizes. Portable flexible sheet containers, such as baby wipes containers, cleaning towels containers, and the like are popular for their mobility. Dispensing versions of these containers are particularly popular for their ease of use. They are convenient in situations where a user needs to quickly and repeatably grab wipes or towels. For example, when a messy spill occurs, it is desirable for a user to quickly and easily grab successive cleaning towels as needed while cleaning the spill. In other situations it may be desirable for a user, such as a parent changing a child's diaper, to be able to grab successive wipes with minimal complexity. It may be inconvenient and time consuming to peel-off or otherwise manually separate the towels or wipes.

Refillable versions of flexible sheet containers are also popular. These containers allow a user to save the expense of purchasing a new container along with each new packet of flexible sheets. Further, they reduce waste, since many containers may be refilled numerous times. They are also economical for carrying fewer amounts of wipes, such as is the case with refillable mini-packets, because replacement sheets can generally be purchased in bulk for less per sheet than in smaller quantities.

With many of these dispensing containers, it is often necessary to feed a leading sheet of a stack of sheets into the dispenser. This may be necessary, for example, when refilling sheets. It may also be necessary to feed a leading sheet at other times, such as when opening a new container with pre-filled, but not pre-fed sheets. Further, sheets sometimes tear during dispensing. They may also jam or otherwise fail to dispense properly. It is necessary in these instances to re-feed a leading sheet.

The process of feeding a leading sheet in many of the existing containers entails a user removing a cover to gain access to an underside of the dispenser. For example, a user may need to push or "feed" a leading sheet from underneath through the dispenser portion of the container. With other existing containers, a user may need to thread a finger through a tight orifice to grab a leading sheet. A user may also need to use a tool to feed a flexible sheet through an orifice. These options are not desirable, particularly for portable containers or in situations where a user needs quick access to additional sheets.

SUMMARY OF THE INVENTION

The present invention provides a flexible sheet dispensing container that allows a user to quickly and easily feed a leading sheet. It effectively dispenses a single sheet at a time and also permits finger access to the storage area of the container through the dispenser opening as needed to feed a leading sheet. This permits the user to quickly and easily feed a leading sheet into the dispenser and then proceed with dispensing sheets. These advantages are appropriate for a variety of dispensing containers from relatively inexpensive portable wipes containers to larger and more expensive cleaning towel dispensers.

In one embodiment, a flexible sheet container according to the present invention includes a container having a base portion that includes a storage area and a top covering the base portion. The top is preferably movable with respect to the base for allowing the sheets to be refilled or replaced. The top includes an opening into the storage area through which the individual sheets are dispensed. A pair of opposing flaps is attached to the top that together further define the dispensing opening. The flaps are pivotally mounted to the top, and according to one aspect of the invention, are mounted via living hinges. The pivoting flaps allow a user to access the storage area with their fingers and to feed a leading sheet through the opening.

According to another aspect of the invention, the flaps only pivot within the flexible sheets storage area. According to a further aspect, the container includes stops for limiting the flaps from rotating upward beyond an outer plane of the top. In yet another aspect of the invention, the flaps include complementary notches at their distal ends that form the dispensing opening. Other aspects of the invention include methods for feeding a leading sheet and for refilling sheets.

BRIEF DESCRIPTION OF THE DRAWINGS

The invention will be described in detail in the following description of preferred embodiments with reference to the following figures wherein.

DETAILED DESCRIPTION OF THE INVENTION

Figure 9:
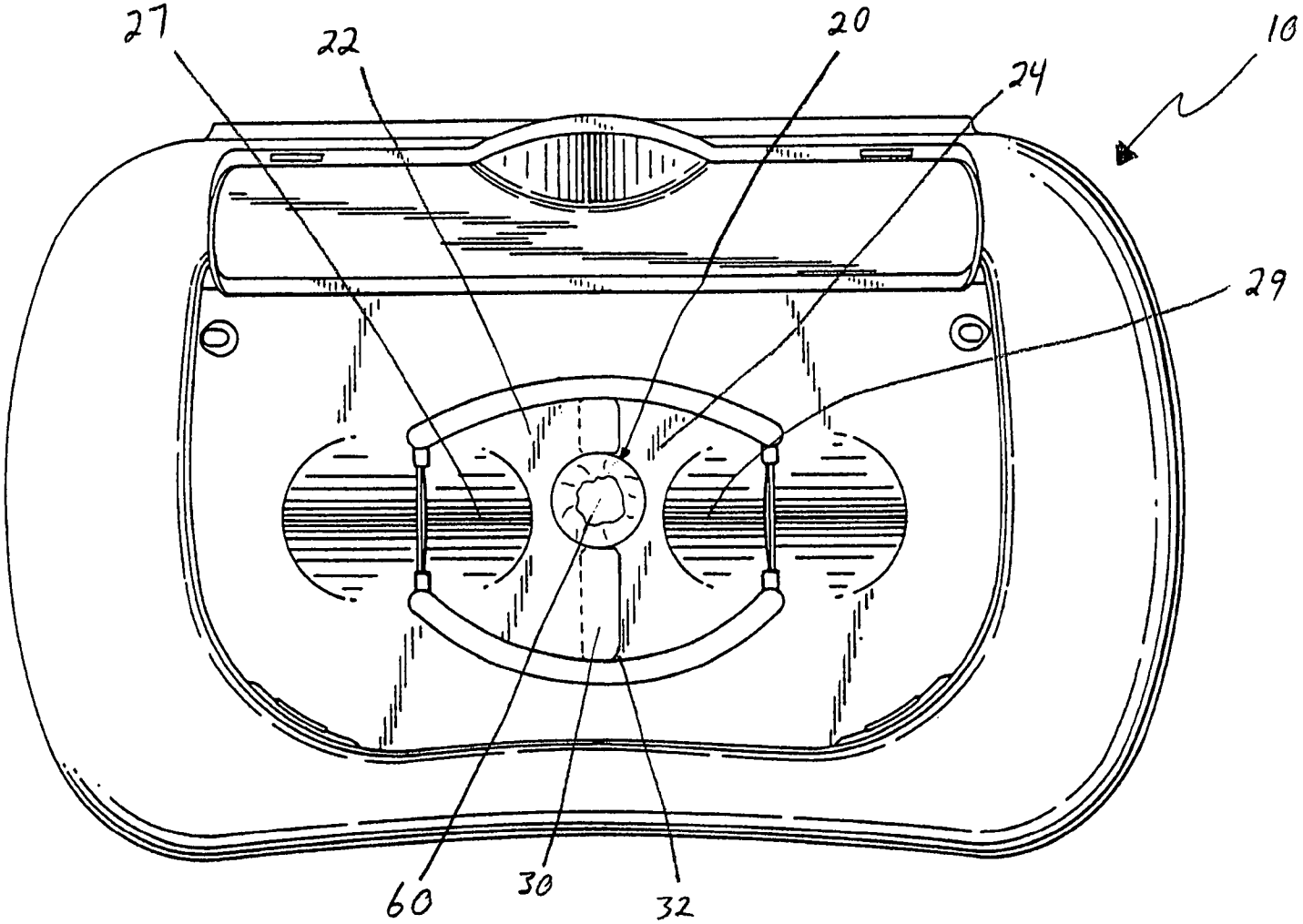
FIG. 9 is a top view of the container of FIG. 8.
Figure 10:
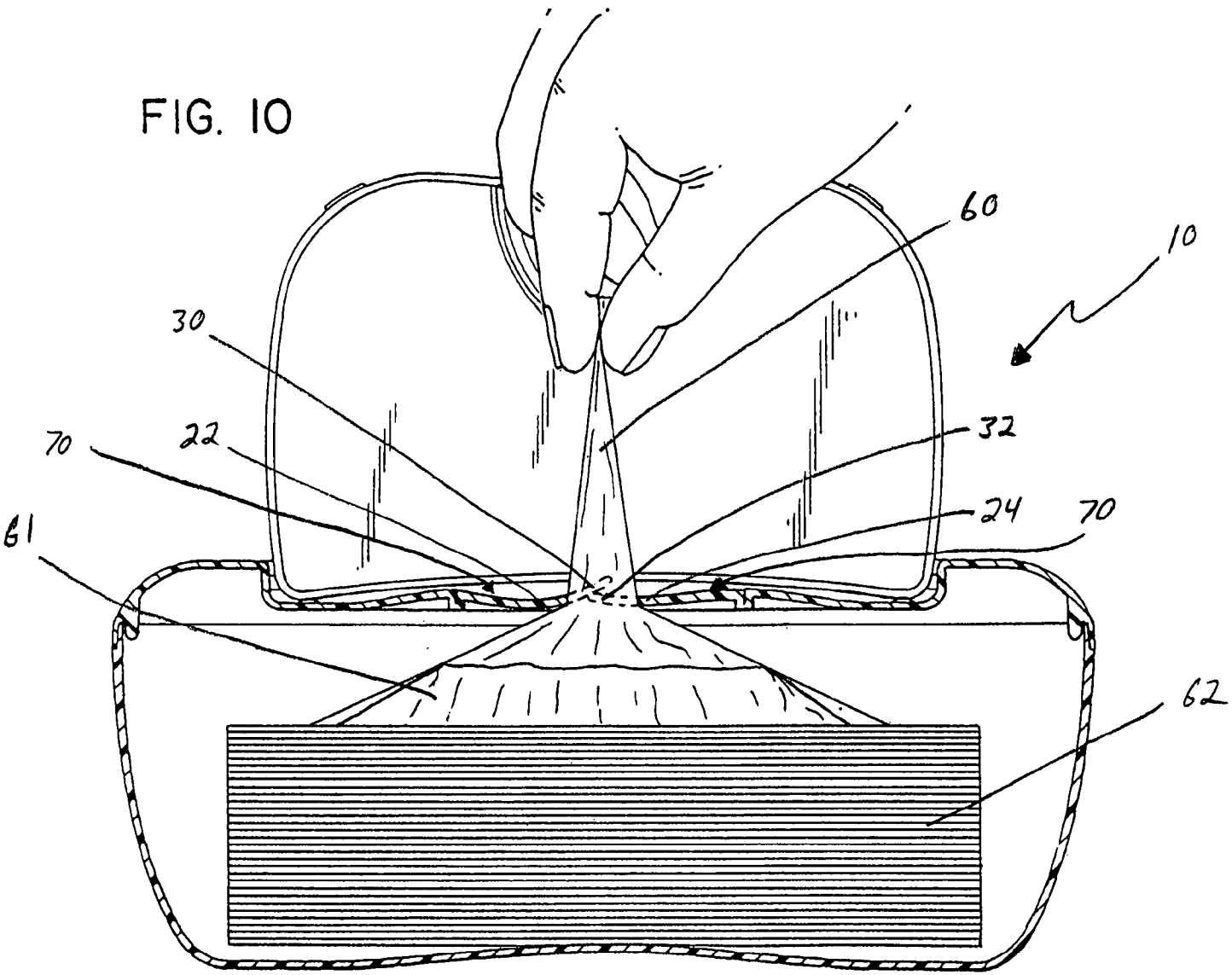
FIG. 10 shows a view similar to FIGS. 7 and 8 with the user dispensing a sheet from the container.
Figure 11:
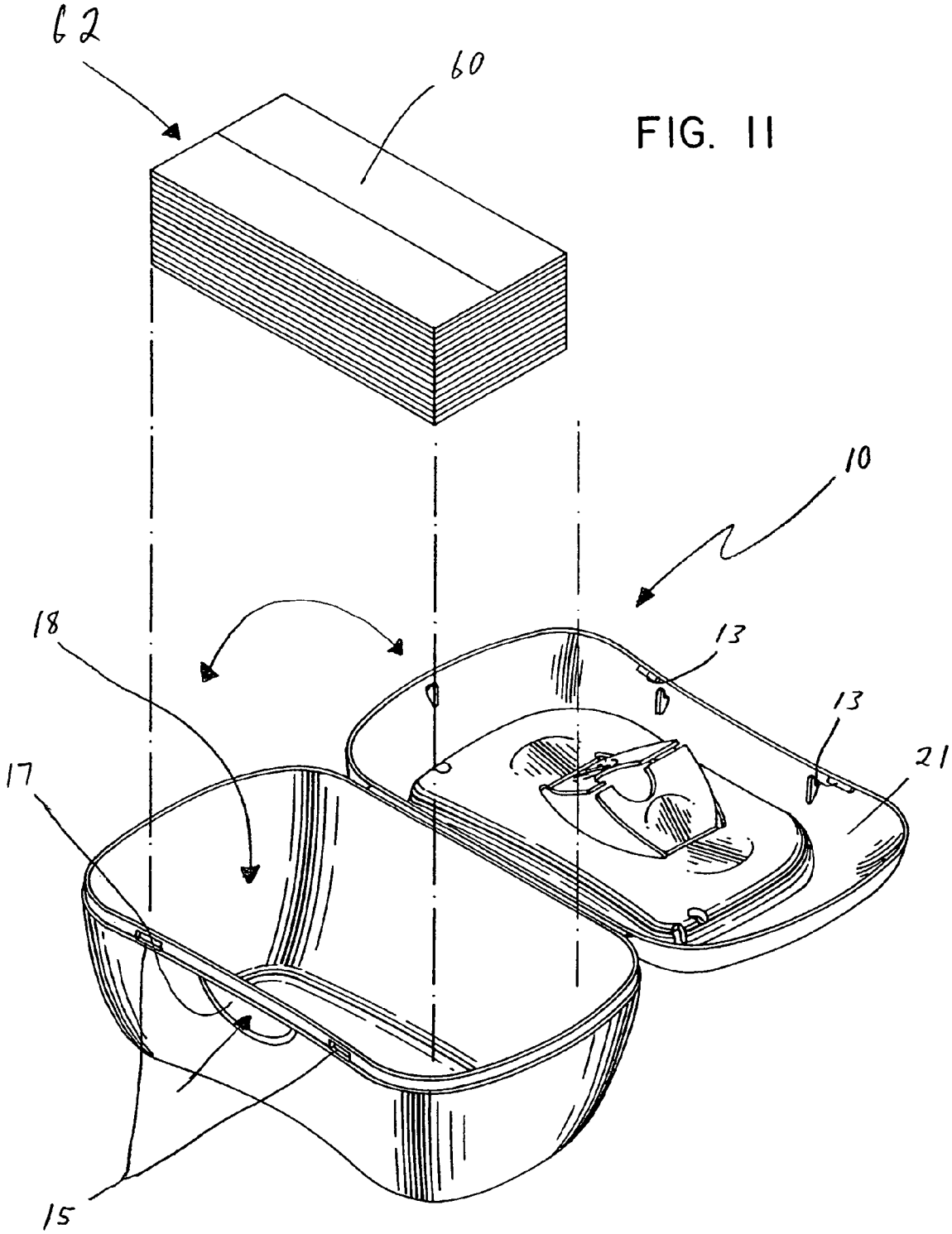
FIG. 11 is an exploded view of the container and a refill stack of sheets according to a further embodiment of the invention.

The invention may be embodied in various forms. As shown in FIGS. 1-11 in general and FIGS. 1-6 in particular, one embodiment according to the present invention includes a container 10 having a base portion 12 and a top 14. The base portion 12 includes a bottom 15 and a plurality of walls 16 that define a storage cavity 18 for storing flexible sheets. The top 14 is pivotally connected to base portion 12 for pivoting between a closed position, in which top 14 covers storage cavity 18 (see FIG. 1), and an open position exposing storage cavity 18 (see FIG. 11). The pivotal connection is preferably accomplished by an integrally molded hinge 19. A stack 62 of flexible sheets may be loaded while storage cavity 18 is exposed in the open position. The container 10 may also be purchased with stack 62 pre-loaded in storage cavity 18. To assist with retaining the top 14 in a closed position, as shown in FIG. 11, top 14 may include locking tabs 13 that engage locking recesses 15 in base portion 12 when top 14 is closed. To assist with unlocking top 14, base portion 12 may also include depression 17, which permits a user to flex locking recesses 15 out of engagement with locking tabs 13.

The top 14 defines a dispenser opening 20 that permits flexible sheets stored in storage cavity 18 to be dispensed. The top 14 includes a lid 21 pivotally attached to the top 14, which is movable between a closed position (not shown) for covering dispenser opening 20 and an open position for exposing the dispenser opening 20. The lid 21 may include snap fit tabs 27 that engage projections 29 on cover 14 in the closed position. The base portion 12 and top 14 shown in these figures are illustrated according to one embodiment having an aesthetically pleasing contour. However, such contouring is not necessary and a multitude of alternative contours could be used to perform equally well.

Figure 7:
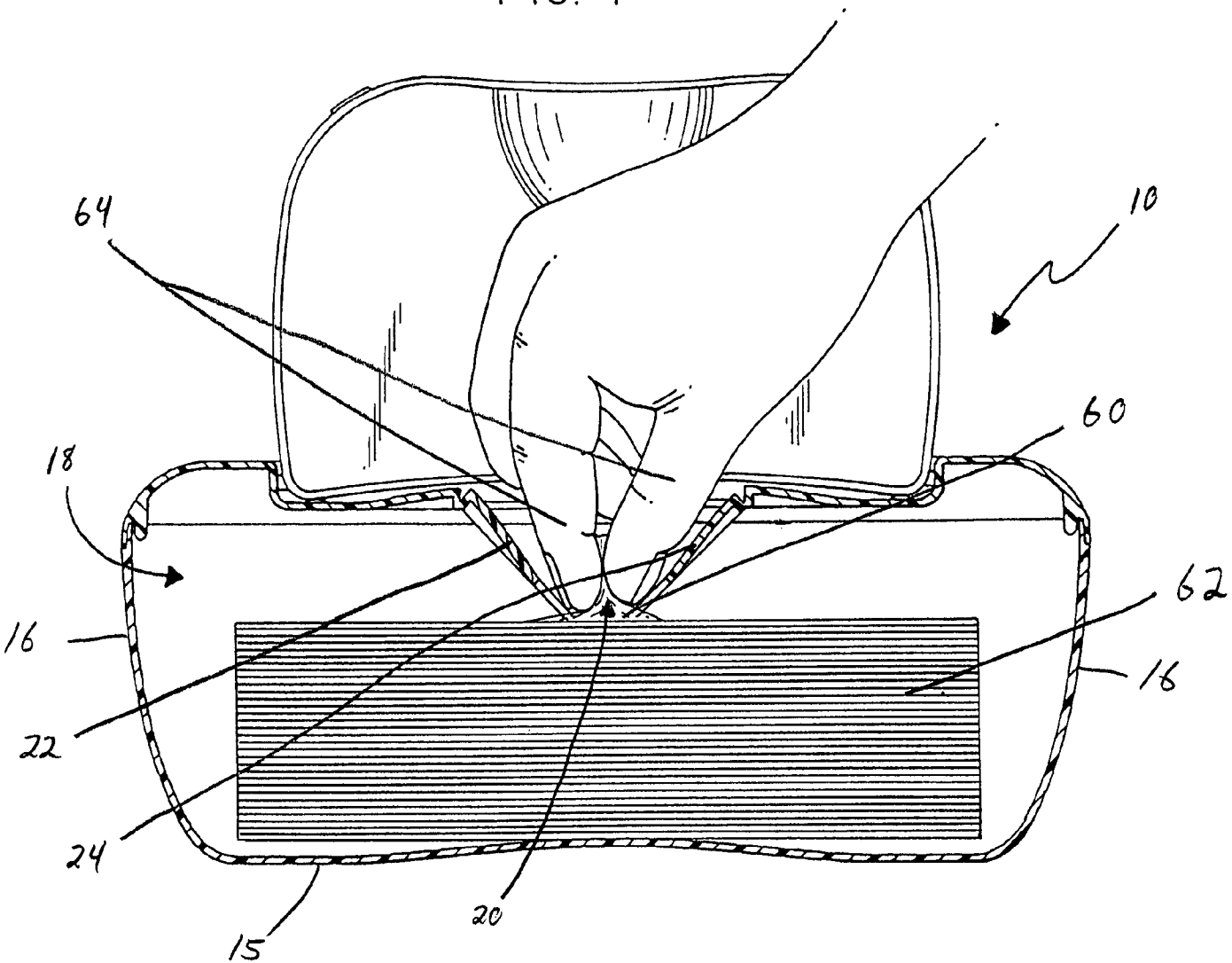
FIG. 7 shows a sectional cut-away view of the container of FIG. 1 with a user initiating the feeding of a leading sheet.
Figure 8:
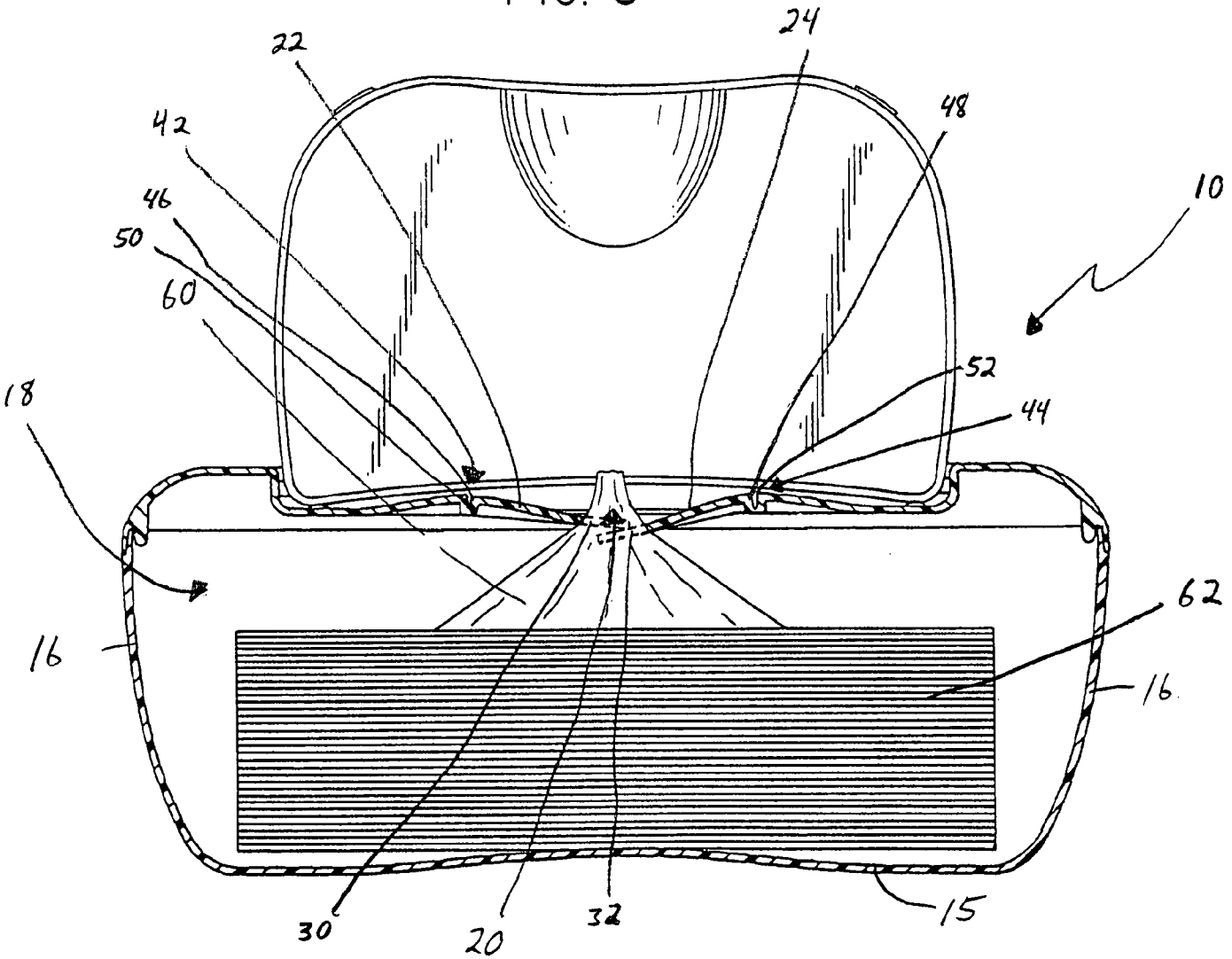
FIG. 8 shows a similar view to FIG. 7 with a leading sheet fed through the dispenser opening.

The top 14 also includes a pair of opposing flaps 22, 24 pivotally connected to top 14. The flaps 22, 24 according to this embodiment generally have a primary range of motion located within storage cavity 18. As shown in FIGS. 6-10, flaps 22, 24 rotate inward toward the interior of storage cavity 18, which is generally a downward direction in this embodiment, and outward away from the interior of the cavity 18, which is a generally upward direction in this embodiment. For example, FIG. 7 shows flaps 22, 24 in an inward/downward position and FIG. 8 shows flaps 22, 24 rotated outward/upward from the position of FIG. 7. Further, FIG. 10 shows flaps 22, 24 rotated even further upward from the position of FIG. 8. It is understood that the opening 20 and related structure in this embodiment could be on a side wall or bottom wall in lieu of top wall 14. As such, in other embodiments, flaps 22, 24 may also rotate sideways or in other directions according to their location, and may rotate outside of storage cavity 18.

Each opposing flap 22, 24 generally includes a fist end 26, 28, which is proximate to top 14 and is pivotally connected thereto. Each flap 22, 24 also includes a second end 30, 32 opposite the first or proximate end 26, 28. The second end 30, 32 of each flap 22, 24 extends toward dispensing opening 20 and opposes the second end of the other flap. Thus, second ends 30, 32 are distal from the pivotal connection to top 14 at corresponding proximate end 26,28. The distal ends 30, 32 complement each other and together define dispensing opening 20. According to one embodiment, each distal end 30, 32 includes a U-shaped notch 34, 36 formed therein. As discussed below, when a flexible sheet is fed into dispensing opening 20, flaps 22, 24 overlap at their distal ends 30, 32 and U-shaped notches 34, 36 define a substantially circular orifice as dispensing opening 20.

Figure 1:
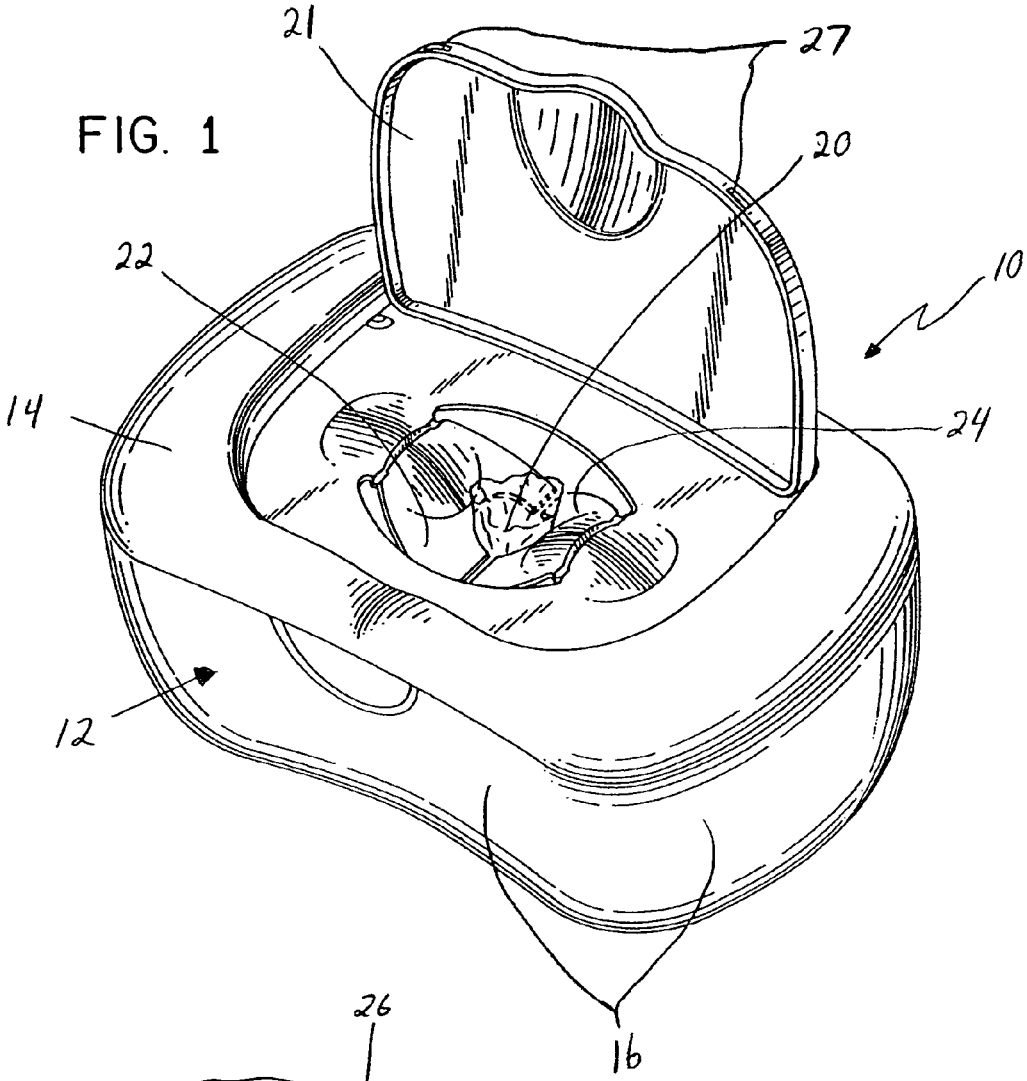
FIG. 1 is a perspective view of flexible sheet container in accordance with one embodiment of the invention.
Figure 2:
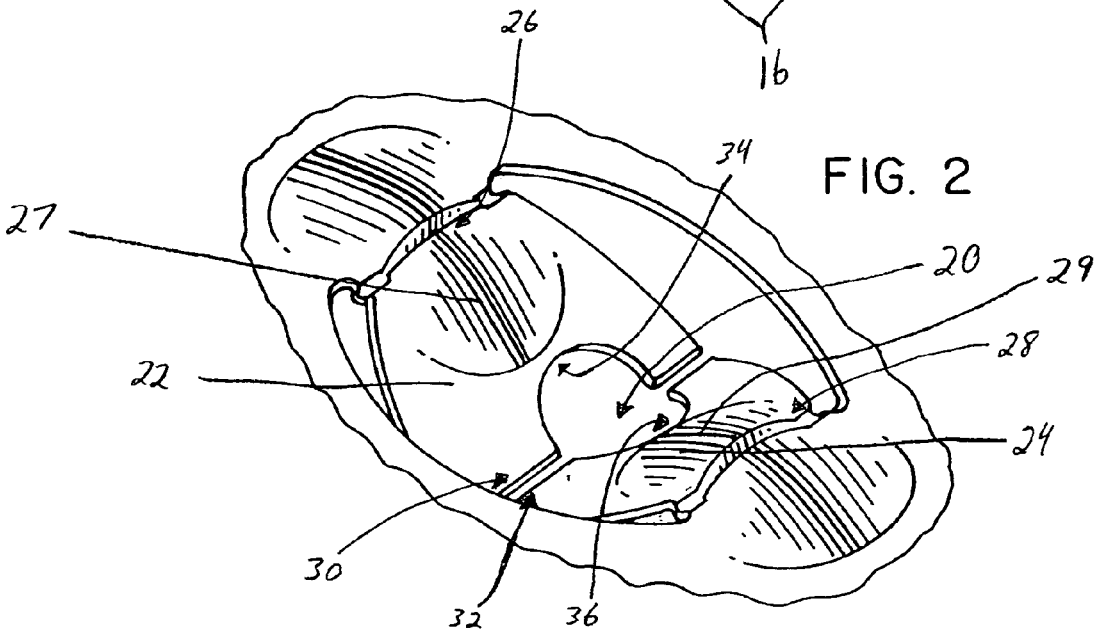
FIG. 2 is a detailed perspective view of the dispenser opening for the container of FIG. 1.
Figure 3:
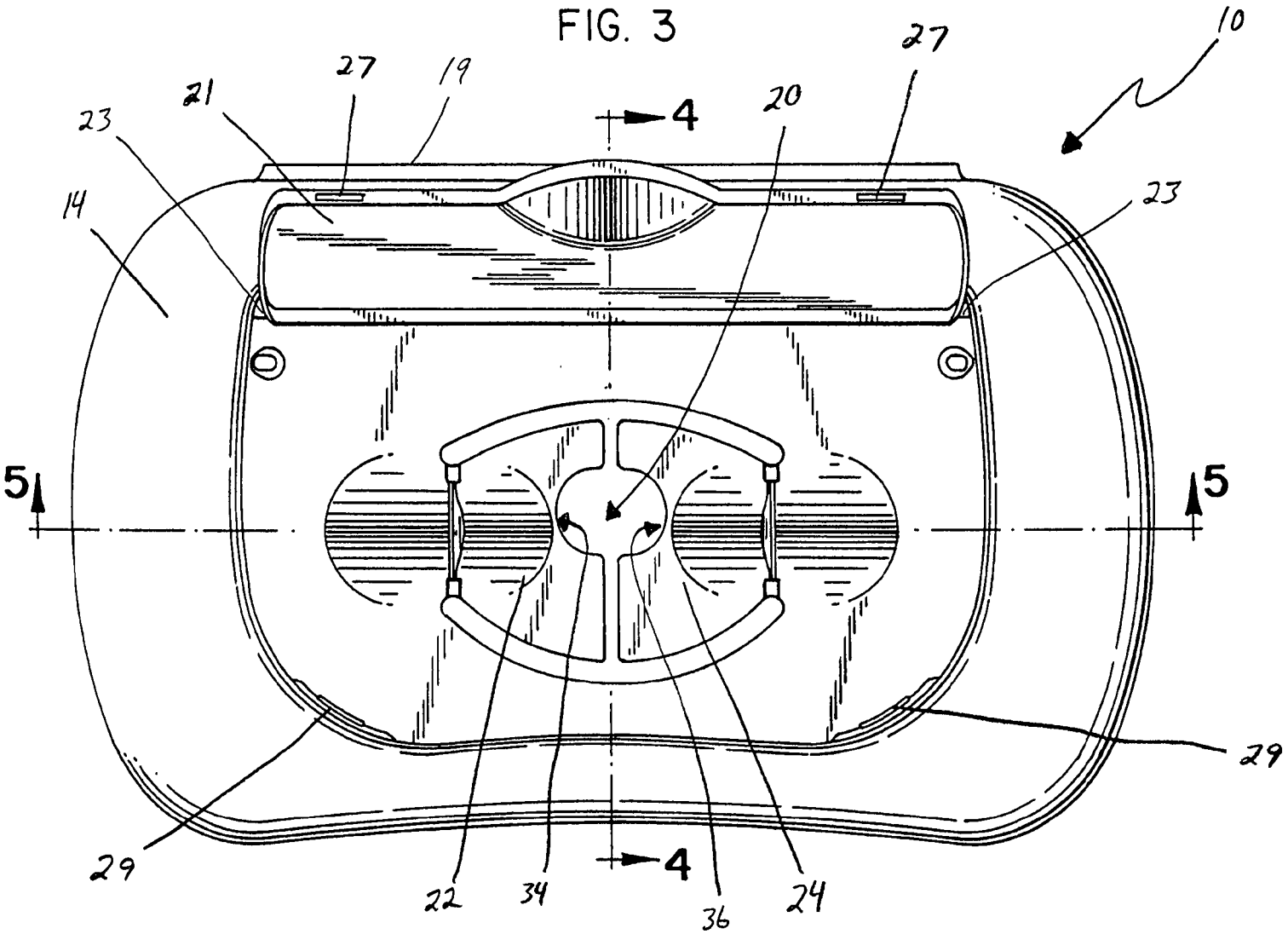
FIG. 3 is a top view of the container of FIG. 1.
Figure 4:
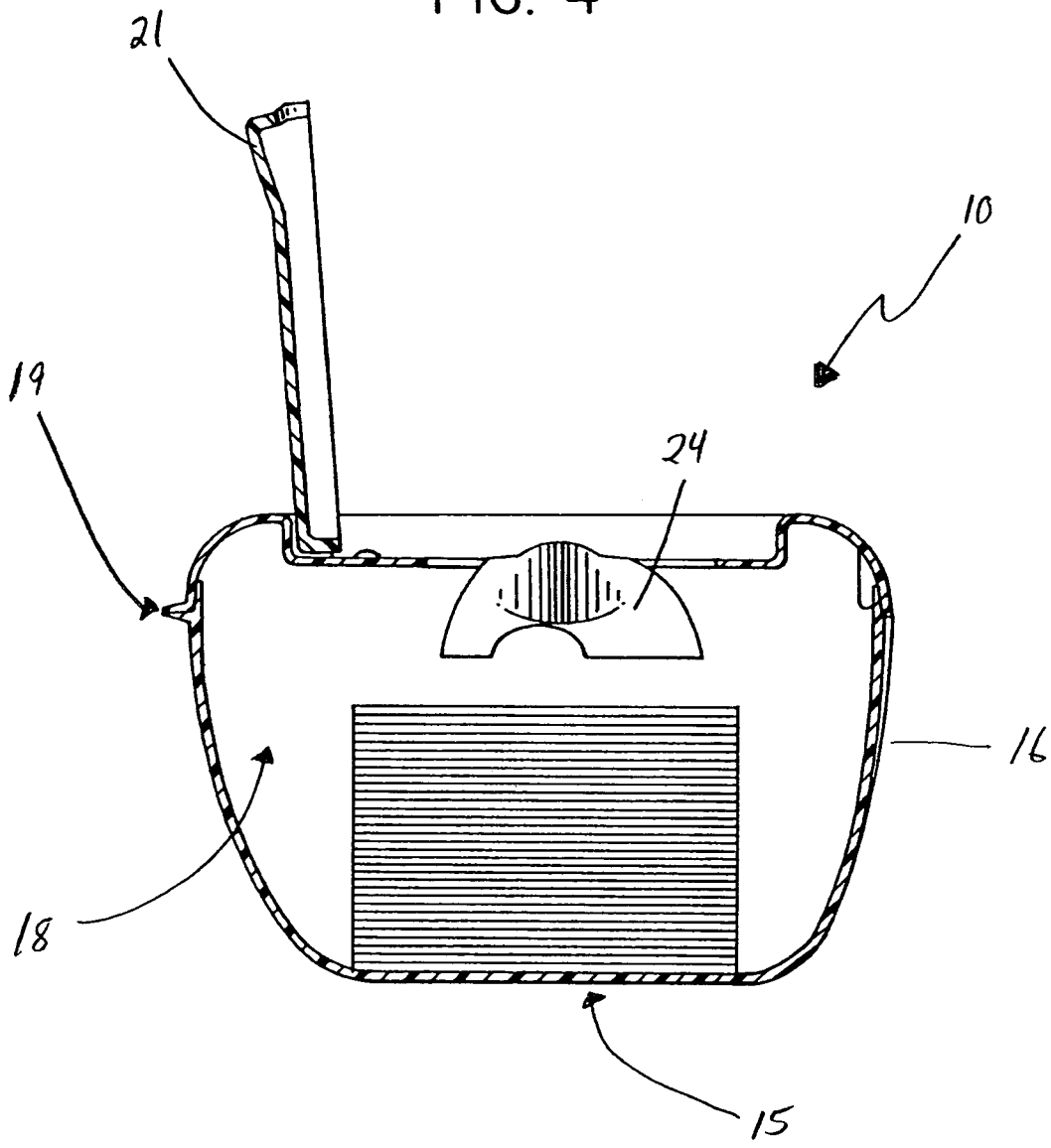
FIG. 4 is a cross-sectional view taken through line 4-4 of FIG. 3.
Figure 5:
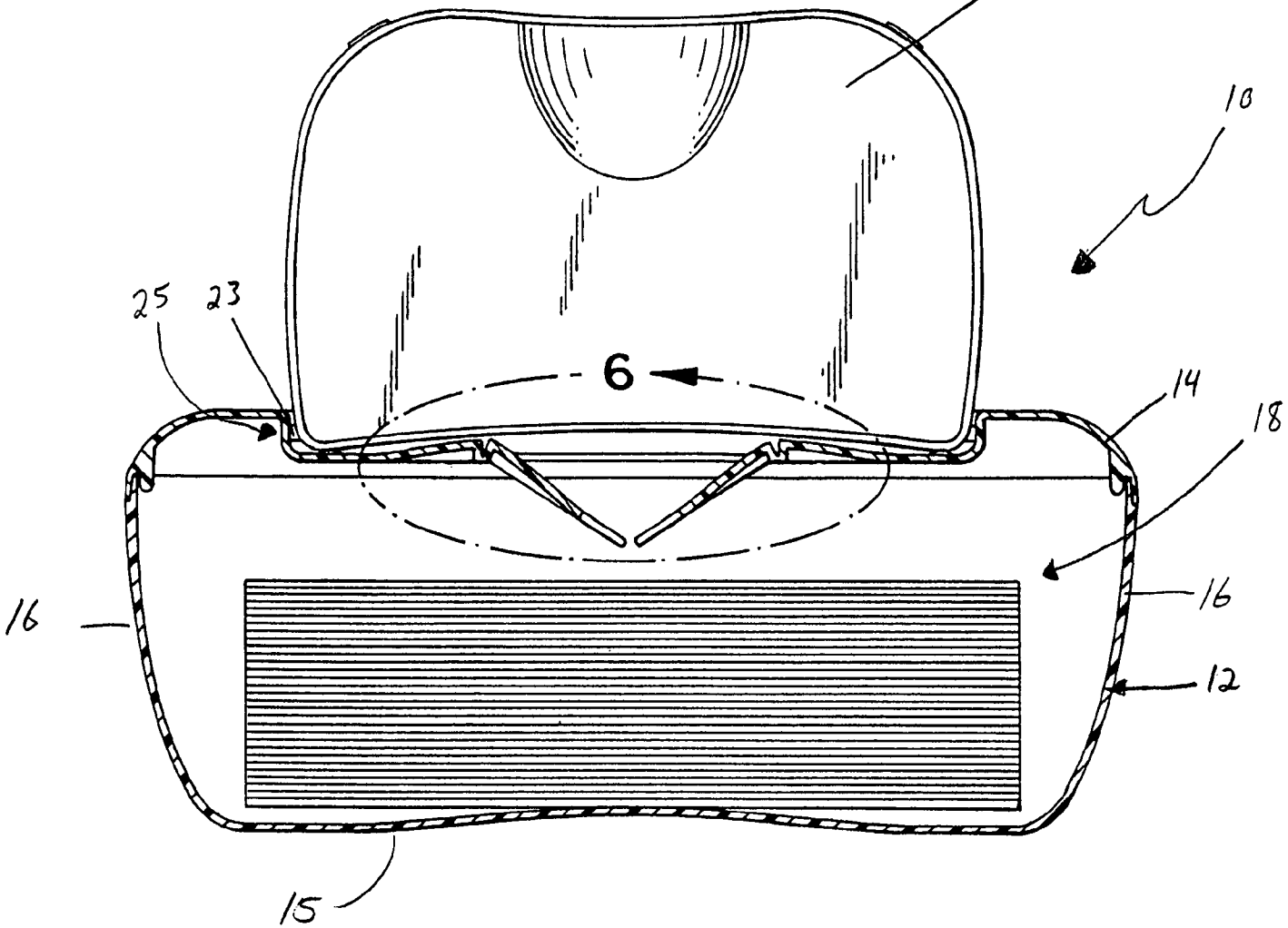
FIG. 5 is a cross-sectional view taken through line 5-5 of FIG. 3.
Figure 6:
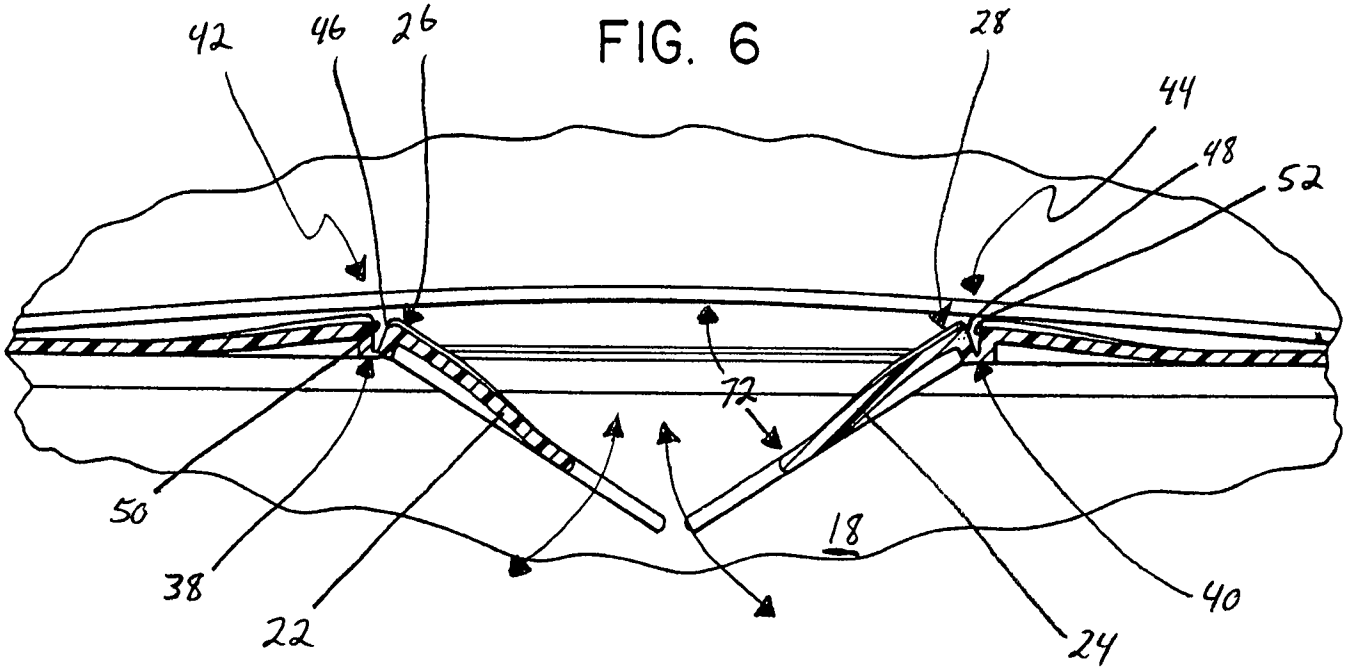
FIG. 6 shows the detail area of the dispensing opening and flaps as indicated in FIG. 5.

As shown in FIG. 6, the proximate ends 26, 28 are each pivotally attached to top 14 via respective living hinges 38, 40. The living hinges include areas of repeatably bendable elastic material that permit rotation of the respective flaps 22, 24 inward into storage cavity 18. In order to limit outward rotation of flaps 22, 24, the container also includes a stop 42, 44 for each flap 22, 24. Each stop 42, 44 includes a first stop surface 46, 48 and a complementary second stop surface 50, 52, which abut each other in a rotation-limiting stop position. The stop surfaces 46, 48, 50 and 52 may be planar or any other shape that permits operation of the stops. Preferably, corresponding stop surfaces 46 and 50 or 48 and 52 engage each other at a point of rotation for the respective flap 22, 24 that prevents the proximal end from rotating beyond zero degrees with top 14. The stops may further include a multitude of different rotation limiters, such as stop blocks or interference tabs.

The first stop surface 46, 48 of each flap 22, 24 is disposed on proximate end 26, 28 near living hinge 38, 40. Accordingly, each first stop surface 46, 48 rotates along with the corresponding flap 22, 24. Each first stop surface 46, 48 is oriented parallel to its respective living hinge 38, 40, and therefore rotates in a direction perpendicular to the respective living hinge 38, 40 along with the corresponding flap 22, 24. Each second stop surface 50, 52 is disposed on top 14 in a position proximate to a respective one of the living hinges 38, 40, and is parallel to and opposite of a corresponding one of first stop surfaces 46, 48.

As shown in FIG. 10, during dispensing of a sheet, flaps 22, 24 are rotated upward to a dispensing position 70 in which the flaps are nearly coplanar with an upper surface of top 14. In this position, each second stop surface 50, 52 contacts a corresponding first stop surface 46, 48. Such contact limits further upward rotation of each flap 22,24 at its proximate end 26, 28 near its respective hinge 38, 40. Downward rotation of flaps 22, 24 may be limited by contact with a stack of flexible sheets, as shown in FIG. 7, or through other limits, such as contacting a portion of container 10. Accordingly, flaps 22, 24 are free to rotate downward and upward between dispensing position 70 and a downward position that provides access to flexible sheets.

The stops 42, 44 according to one embodiment are integrally formed in the geometry of flaps 22, 24 and top 14 through an injection molding process. Such a manufacturing process allows first stop surfaces 46, 48 to be formed in the geometry of corresponding flaps 22, 24, and second stop surfaces 50, 52 to be formed in the geometry of top 14. It also allows for hinge 19 to be integrally formed with top 14 and base portion 12 for pivotally connecting the top to the base portion. As such, base portion 12 and top 14 are made from an injection molded plastic, such as polypropylene. Injection molding further allows living hinges 38, 40 to be integrally formed from areas of material with reduced thickness that each connects a corresponding flap 22, 24 to cover 14.

Such a manufacturing process provides many advantages beyond integral formation of many components of the container. The use of a molded plastic material, such as polypropylene, permits flexibility in flaps 22, 24. Such flexibility provides benefits during dispensing of sheets as discussed below. Further, as shown in FIG. 6, flaps 22, 24 are molded in an angled position 72 sloping downward toward storage cavity 18. As such, flaps 22, 24 are slightly biased downward, which provides benefits during dispensing of sheets. Molding flaps 22, 24 in an angled position also allows stop surfaces 46, 48, 50 and 52 to be integrally molded by simply using two or more halves of a mold tool (not shown) without the use of special slides or other expensive and time-consuming manufacturing steps. This is because a portion of the mold tool (not shown) matching the outer portion of top 14 can form outer portions of stop surfaces 46, 48, 50 and 52 when flaps 22, 24 are molded at downward angle 72. The lid 21 is preferably formed separately and pivotally attached via a pin 23 and socket 25 connection.

In operation, container 10 according to one embodiment permits a user to easily add flexible sheets to the container, to feed a leading sheet through dispenser opening 20, and to thereafter dispense sheets. As shown in FIGS. 7-10, in order to dispense sheets, a leading sheet 60 of the stack of flexible sheets 62 stored in storage cavity 18 is fed through dispenser opening 20. The stack 62 of sheets may include refill sheets loaded by a user as discussed below with regard to FIG. 11. They may also be pre-loaded sheets that have not been fed through dispenser opening 20. In addition, if a sheet needs to be fed for other reasons, such as due to tearing of a sheet during dispensing, due to a jam in dispenser opening 20, or due to a sheet otherwise falling back down on to stack 62, a leading sheet may easily be fed through dispenser opening 20 without opening top 14. Such a leading sheet 60 may be fed via a user entering storage cavity 18 with his fingers 64 and grabbing the leading sheet 60. The flaps 22, 24 permit such entry by rotating downward toward storage cavity 18. As they rotate downward, opening 20 between distal ends 30, 32 becomes large enough to permit the entry of the user's fingers 64. Accordingly, a user may easily enter storage cavity by pushing downward on flaps 22, 24 without forcing his fingers 64 into tight fitting dispensing orifices.

After the user grabs leading sheet 60, he feeds the sheet by pulling it upward through opening 20. As this occurs, flaps 22, 24 rotate upward along with leading sheet 60, as shown in the transition between FIGS. 7 and 8. While rotating upward, portions of distal ends 30, 32 begin to overlap. Overlapping portions of distal ends 30, 32 guide leading sheet 60 into dispenser opening 20, which is now defined by U-shaped notches 34, 36, as the leading sheet 60 is pulled upward. As flaps 22, 24 continue rotating upward, dispenser opening 20 becomes smaller until a substantially circular orifice is formed as shown in FIG. 9. In one embodiment, the orifice preferably has a diameter of 0.625 to 0.875 inches and more preferably is about 0.75 inches. Such a diameter compresses leading sheet 60 at the location of dispenser opening 20 in a fed condition. The circular orifice is generally formed when flaps 22, 24 are disposed in dispensing position 70. In this position, flaps 22, 24 frictionally retain leading sheet 60.

To dispense a sheet, a user pulls leading sheet 60, which will be withdrawn in a compressed state through circular dispensing opening 20. The leading sheet 60 is compressed at the location of opening 20 and is generally uncompressed above and below opening 20. As sheet 60 is withdrawn, the first stop surfaces 46, 48 of stops 42, 44 make contact with second surfaces 50, 52 while flaps 22, 24 attempt to follow sheet 50 and rotate upward due to frictional engagement. The stops 42, 44 restrict rotation of flaps 22, 24 beyond such a position. As leading sheet 60 continues to be withdrawn, distal ends 30, 32 of flaps 22, 24 are flexed upward. The use of a plastic material such as polypropylene permits flaps 22, 24 to act as spring arms and flex beyond the point of engagement by stops 42, 44, as shown in FIG. 10. In a flexed condition, distal ends 30, 32 of flaps 22, 24 pull downward on leading sheet 60 and a subsequent sheet connected thereto as it enters opening 20. The downward pull on the sheets assists with dispensing of the sheets and reducing loss of fluids impregnated in the sheets, as discussed below. Geometry, such as ridges 27, 29 on each flap 22, 24, may reinforce the flaps as needed to fine tune the amount of flexibility in the flaps.

Flexibility and the spring arm action of flaps 22, 24 assist with the dispensing of sheets retained in a connected stack, such as stack 62. Connected stack 62 may include overlapped and interfolded sheets as known in the art that are stacked to encourage subsequent sheets to follow each other during dispensing. With such a stack, pulling leading sheet 60 upward through dispensing opening 20 results in a subsequent sheet 61 being partially pulled through dispenser opening 20, which feeds the subsequent sheet. As leading sheet 60 clears dispenser opening 20, the flexed flaps 22, 24 act to pull subsequent sheet 61 back toward storage cavity 18. Further, because flaps 22, 24 are naturally angled downward as molded with angle 72, and because gravity acts to encourage the flaps 22, 24 downward, they are biased toward such an downward position. As such, flaps 22, 24 pull subsequent sheet 61 further downward toward storage cavity 18 after leading sheet 60 is dispensed. Partial retraction of subsequent sheet 61 into storage cavity 18 exposes less of the subsequent sheet outside of storage cavity 18, which reduces the amount of drying out of fluid that may be impregnated in stack 62. Rotating lid 21 to a closed position that covers dispensing opening 20 further limits such drying out, as lid 21 may form a seal between the lid 21 and top 14 that is substantially airtight.

The rotatable flaps 22, 24 assist in dispensing of the sheets and they provide a quick and easy way for a user to feed a leading sheet. Thus, a container according to the present invention has advantages for both feeding and dispensing of flexible sheets. With a single hand, and without opening cover 14, a user can quickly and easily feed leading sheet 60 with access through flaps 22, 24. A user may also continue dispensing leading sheet 60 as a natural continuation of feeding the sheet, and may then immediately follow-up dispensing subsequent sheets. If a supply of sheets is depleted, the present invention also permits a refill stack of sheets 62 to be quickly and easily installed.

To install a refill supply of sheets, a user rotates cover 14 to an open position shown in FIG. 11, which exposes storage cavity 18. The user then simply inserts refill packet 62, and rotates cover 14 into a closed position that covers storage cavity 18. Because the present invention permits a user to quickly and easily feed a leading sheet, the user may wait to feed a leading sheet until sheets need to be dispensed.

While the present invention has been described in connection with the illustrated embodiments, it will appreciated and understood that modifications may be made without departing from the true spirit and scope of the invention. In particular, various numbers of flaps may be used that create various shapes and sizes of dispensing openings. Further, the container may be made in a variety of ways with a variety of materials, and may use different types of hinges. The container may also be used with a continuous stack of sheets having perforations between sheets, or a roll of sheets, or other such configurations.

We claim:

1. A container comprising:

a plurality of walls defining a storage cavity, a first wall of the plurality of walls having a dispenser opening formed therethrough;

a first flap having first and second opposed ends, said second end extending toward said opening;

a second flap having first and second opposed ends, said second flap second end extending toward said opening;

a first living hinge connecting said first flap first end to said first wall, said first living hinge having a neutral position orienting said first flap second end sloping inward of said storage cavity in the absence of an upward force applied to the first flap;

a second living hinge connecting said second flap first end to said first wall, said second living hinge having a neutral position orienting said second flap second end sloping inward of said storage cavity in the absence of an upward force applied to the second flap;

a first stop limiting rotation of said first flap outward away from said storage area; and a second stop limiting rotation of said second flap outward away from said storage area.

2. The container of claim 1, wherein said living hinges comprise an elastic material.

3. The container of claim 2, wherein said elastic material comprises a thermoplastic.

4. The container of claim 3, wherein said thermoplastic comprises polypropylene.

5. The container of claim 1, wherein each said flap is biased toward said neutral position disposed within said storage area.

6. The container of claim 1, wherein each said stop comprises:

a first surface attached to said first wall proximate to the first end of one of said flaps; and a second surface attached to said first end of said one of the flaps and contacting said first surface while in a rotation limiting position.

7. The container of claim 1, wherein said first wall defines a first side of said dispenser opening and an opposed second side of said dispenser opening such that said first living hinge connects said first flap first end to said first side of said first wall and said second living hinge connects said second flap first end to said second side of said first wall.

8. A container comprising:

a plurality of walls defining a storage cavity, a first wall of the plurality of walls having a dispenser opening formed therethrough;

a first flap having first and second opposed ends, said second end extending toward said opening;

a second flap having first and second opposed ends, said second flap second end extending toward said opening;

a first living hinge connecting said first flap first end to said first wall, said first living hinge having a neutral position orienting said first flap second end sloping inward of said storage cavity in the absence of a force applied to the first flap; and a second living hinge connecting said second flap first end to said first wall, said second living hinge having a neutral position orienting said second flap second end sloping inward of said storage cavity in the absence of a force applied to the second flap;

wherein a portion of said second flap overlaps a portion of said first flap while said first and second flaps are in a dispensing position.

9. A container comprising:

flexible sheets;

a base portion defining a storage cavity for storing said flexible sheets; and a cover attached to said base portion, said cover including an opening into said storage cavity, a lid covering said opening while in a closed position, a first flap having first and second opposed ends, said second end extending toward said opening, a second flap having first and second opposed ends, said second flap second end extending toward said opening, a first living hinge connecting said first flap first end to said cover, said first living hinge having a neutral position orienting said first flap second end sloping inward of said storage cavity in the absence of a force applied to the first flap, a second living hinge connecting said second flap first end to said cover, said second living hinge having a neutral position orienting said second flap second end sloping inward of said storage cavity in the absence of a force applied to the second flap, a first stop limiting rotation of said first flap outward away from said storage cavity, and a second stop limiting rotation of said second flap outwardly away from said storage cavity.

10. The container of claim 9, wherein said opening is defined by a space between said second ends of said flaps.

11. The container of claim 9, wherein said first flap and second flap include complementary notches at their distal ends that form said opening.

12. The container of claim 9, wherein said first stop and said second stop are stop blocks or interference tabs.

13. The container of claim 9, wherein said first stop and said second stop limit the first flap and second flap from rotating upward beyond an outer plane of the cover.

14. The container of claim 9, wherein each said stop comprises:

a first surface attached to said cover proximate to said first end of one of said flaps; and a second surface attached to said first end of said one of said flaps and contacting said first surface while in a rotation limiting position.

15. A container comprising:

flexible sheets;

a plurality of walls defining a storage cavity for storing said flexible sheets, a first wall of said plurality of walls having an opening formed therethrough;

a first flap having first and second opposed ends, said second end extending toward said opening;

a first living hinge connecting said first flap first end to said first wall, wherein said first flap only pivots within said storage cavity and wherein said first living hinge having a neutral position orienting said first flap second end sloping inward of said storage cavity in the absence of a force applied to the first flap;

a second flap having first and second opposed ends, said second flap second end extending toward said opening;

a second living hinge connecting said second flap first end to said first wall; and wherein said first flap and second flap include complementary notches at their distal ends that from said opening, said first flap and said second flap only pivot within said storage cavity, and said second living hinge has a neutral position orienting said second flap second end sloping inward of said storage cavity in the absence of a force applied to the second flap.

* * * * *